US005815833A

United States Patent [19]

Kuo

[11] Patent Number: 5,815,833

[45] Date of Patent: Oct. 6, 1998

[54] CONVERTIBLE ARTICLE FOR SIMULTANEOUSLY PROVIDING SLEEPING BAG, JACKET AND CARRYING BAG

[76] Inventor: Li-Lin Kuo, P.O. Box 55-846, Taipei, Taiwan

[21] Appl. No.: 15,217

[22] Filed: Jan. 28, 1998

[51] Int. Cl.[6] ..... A41D 15/04; A45F 4/00

[52] U.S. Cl. ..... 2/69.5; 2/84; 2/94; 5/413 AM

[58] Field of Search ..... 2/69.5, 69, 83, 2/84, 85, 86, 89, 93, 94, 108; 5/413 R, 413 AM; 224/156, 153, 576

[56] References Cited

U.S. PATENT DOCUMENTS

| | | | |
|---|---|---|---|
| 1,952,465 | 3/1934 | Rycroft | 2/84 |
| 3,835,471 | 9/1974 | Lankford | 2/84 |
| 3,837,006 | 9/1974 | Laseman | 2/69.5 |
| 4,103,377 | 8/1978 | Mayer et al. | 2/69.5 |
| 4,158,892 | 6/1979 | Gonzales | 2/69.5 |
| 4,192,030 | 3/1980 | Casson | 2/69.5 |
| 4,347,629 | 9/1982 | Itoi | 2/69.5 |
| 4,532,654 | 8/1985 | Sigismonde | 2/69.5 |
| 4,575,397 | 3/1986 | Dennard | 2/69.5 |
| 5,560,043 | 10/1996 | Armstrong | 2/69.5 |

*Primary Examiner*—Amy Vanatta

[57] ABSTRACT

A convertible article includes: a torso bag having a hood detachably securable with the torso bag, with an inflatable pillow attached to the hood and inflated for cushioning a wearer's head; a leg bag detachably securable with the torso bag for forming a sleeping bag to be worn by the wearer for sleeping purpose; and a built-in carrying bag inherently formed in the leg bag, whereby upon inversion of the built-in carrying bag outwardly from the leg bag and folding and insertion of the remaining portion of the leg bag into the carrying bag, the carrying bag can be conveniently carried for storing the torso bag, the hood and other items into the carrying bag.

7 Claims, 8 Drawing Sheets

CONVERTIBLE ARTICLE FOR SIMULTANEOUSLY PROVIDING SLEEPING BAG, JACKET AND CARRYING BAG

BACKGROUND OF THE INVENTION

U.S. Pat. No. 4,158,892 to Gonzales disclosed a sleeping bag convertible into different garments, including front and rear panels that can be zipped together in variable ways.

However, this prior art still has the following drawbacks:

1. After folding the sleeping bag, jacket or vest, it still requires a carrying bag or hand bag for storing the folded articles for handling or storage.
2. The hood (20) is provided just for shielding the wearer's head without additional use. So, when the jacket is served as a sleeping bag, a pillow shall be further provided for cushioning the wearer's head.

The present inventor has found the drawbacks of the conventional convertible sleeping bag and invented the present convertible article for multiple uses.

SUMMARY OF THE INVENTION

The object of the present invention is to provide a convertible article including: a torso bag having a hood detachably securable with the torso bag, with an inflatable pillow attached to the hood and inflated for cushioning a wearer's head; a leg bag detachably securable with the torso bag for forming a sleeping bag to be worn by the wearer for sleeping purpose; and a built-in carrying bag inherently formed in the leg bag, whereby upon inversion of the built-in carrying bag outwardly from the leg bag and foldably inserting the remaining portion of the leg bag into the carrying bag, the carrying bag can be conveniently carried for storing the torso bag, the hood and other items into the carrying bag.

DETAILED DESCRIPTION

Figure 1:
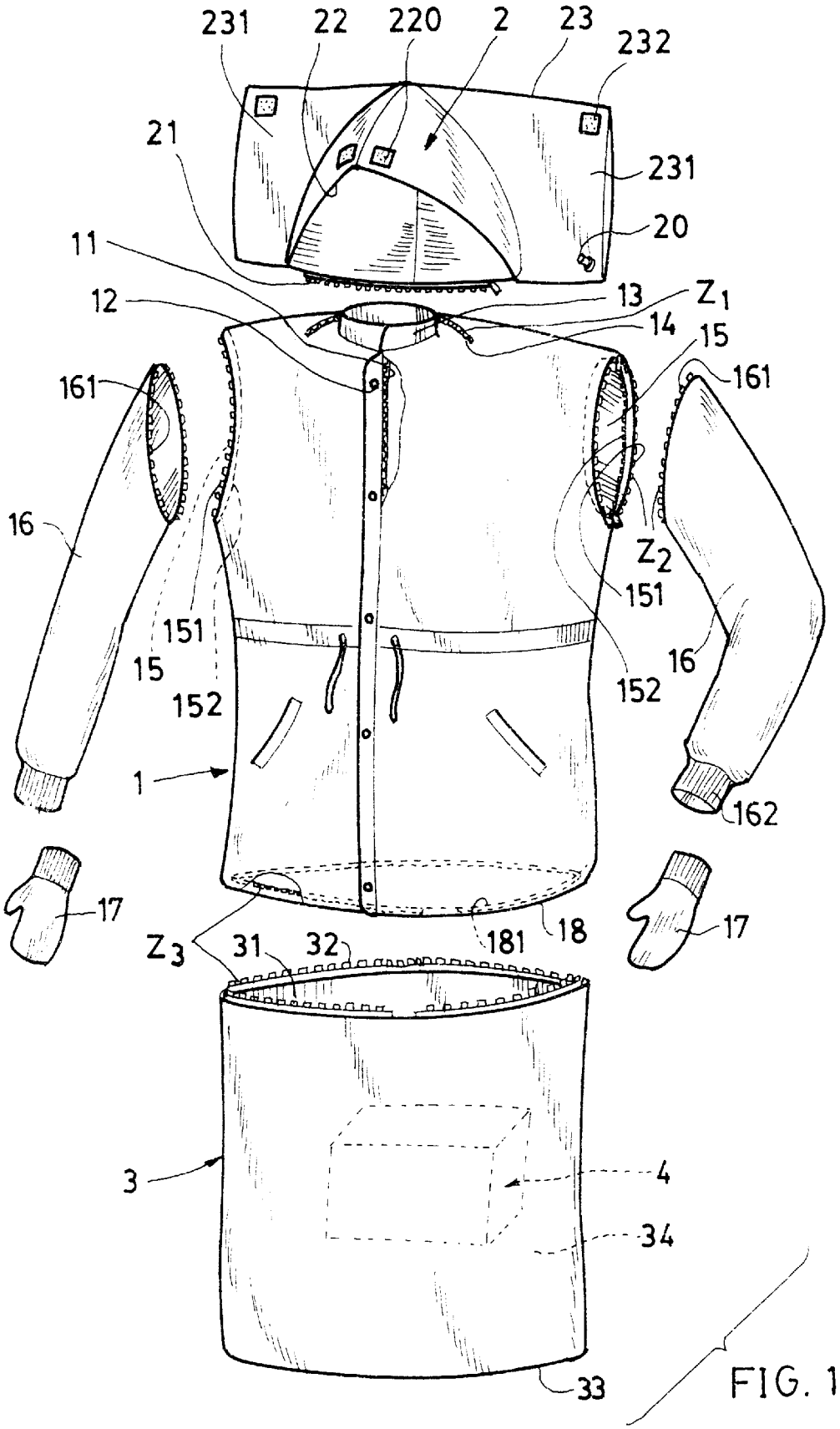
FIG. 1 is an illustration showing the elements in construction of the present invention.

As shown in FIGS. 1–5, the present invention comprises: a torso bag 1, a hood 2 detachably securable to the torso bag 2, and a built-in carrying bag 4 inherently formed in the leg bag 3.

The torso bag 1 generally cylindrical shaped includes: a longitudinal zipper 11 formed in a front portion of the torso bag 1 for opening or closing the torso bag 1, a plurality of buttons 12 equally spaced and formed in the front portion of the bag 1 for opening or closing the torso bag 1, a collar 13 formed on an upper portion of the torso bag 1 corresponding to a wearer's neck portion, a row of collar-side zipper teeth 14 of a hood zipper Z1 partially disposed around the collar 13 and engageable with a row of hood-side zipper teeth 21 of the hood zipper Z1 formed on the hood 2 for fastening the hood 2 on the torso bag 1 adjacent to the collar 13, a pair of shoulder openings 15 formed on opposite sides of a shoulder portion of the torso bag 1 each shoulder opening 15 having a row of shoulder-side zipper teeth 151 of a sleeve zipper Z2 circumferentially formed on a circulaar edge (or rim) of the shoulder opening 15 for engaging a row of sleeve-side zipper teeth 161 circumferentially formed on a circular edge (rim) of a sleeve 16 connected to the shoulder portion of the torso bag 1, and a torso bottom opening 18 formed at a bottom of the torso bag 1 having a row of torso-bottom zipper teeth 181 circumferentially formed on a circular or oval edge (rim) of the torso bottom opening 18 for engaging a row of leg-side zipper teeth 32 of a lower zipper Z3 circumferentially formed on an oval edge (rim) of a top opening 31 of the leg bag 3.

Each sleeve 16 has its lower cuff 162 connectable with a glove 17 for warming the wearer's hand.

Figure 2:
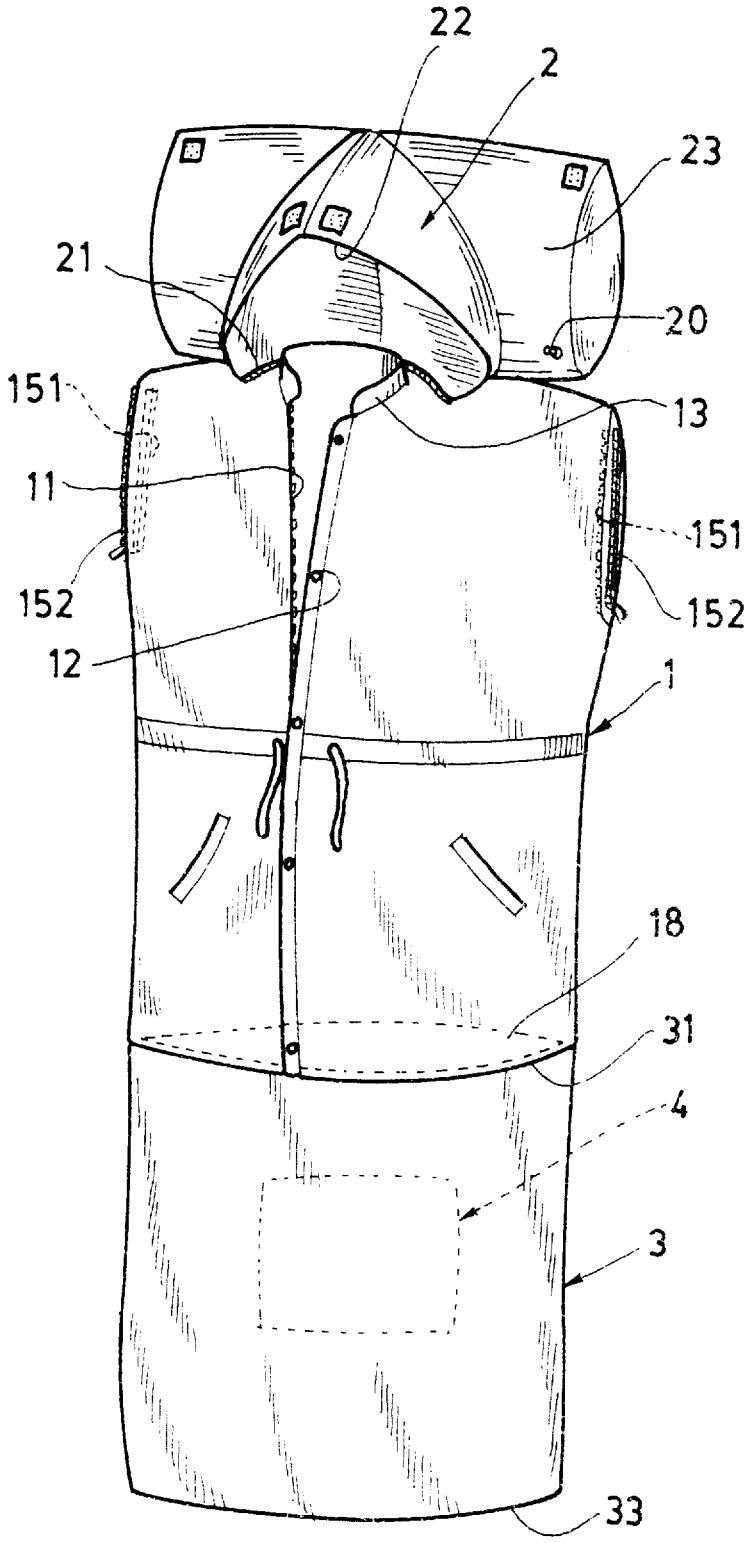
FIG. 2 is a perspective view of the present invention when served as a sleeping bag.

A closable zipper 152 is circumferentially formed on an inner edge of the shoulder opening 15 and is closed for forming a sleeping bag as shown in FIG. 2 when not connected with the sleeve 16.

The materials for making the convertible article of the present invention can be selected from soft, flexible, warm and preferable water resistant materials. A lining may be lined inside the torso bag 1 or the leg bag 3.

Figure 4:
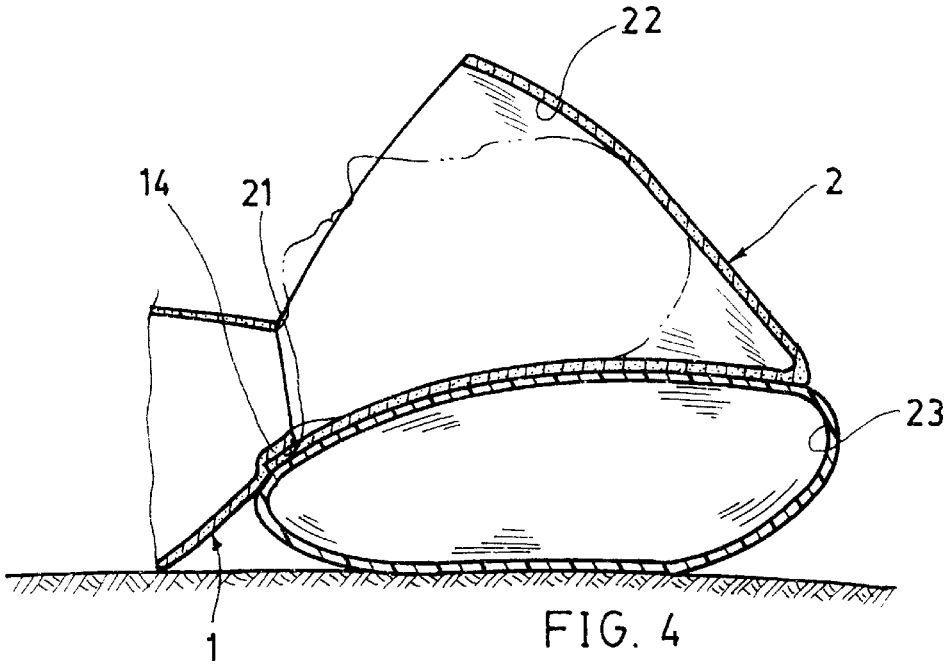
FIG. 4 is a side view illustration of the hood and pillow portion of the present invention.
Figure 5:
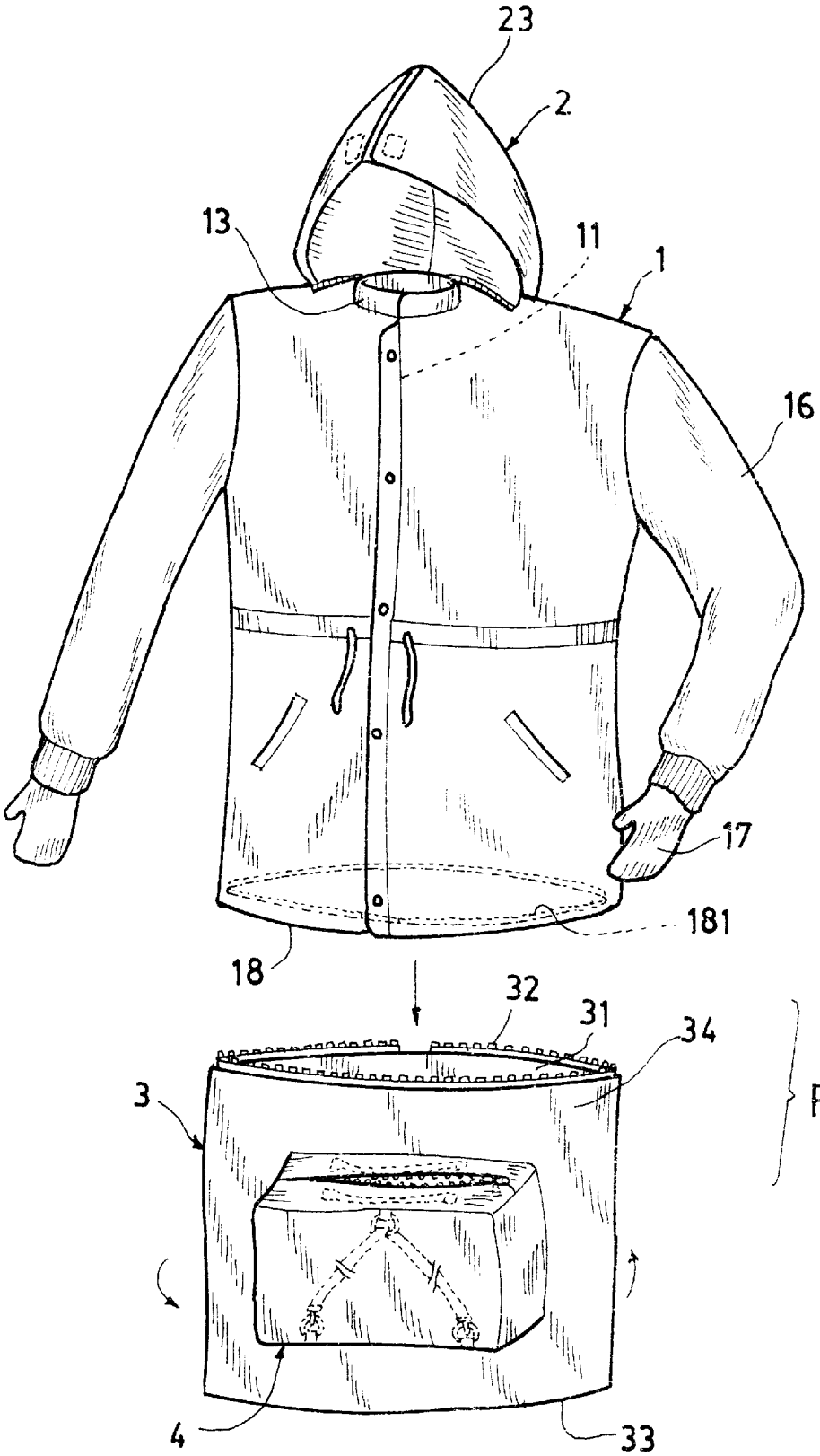
FIG. 5 is an illustration showing a jacket and a leg bag separated each other.
Figure 7:
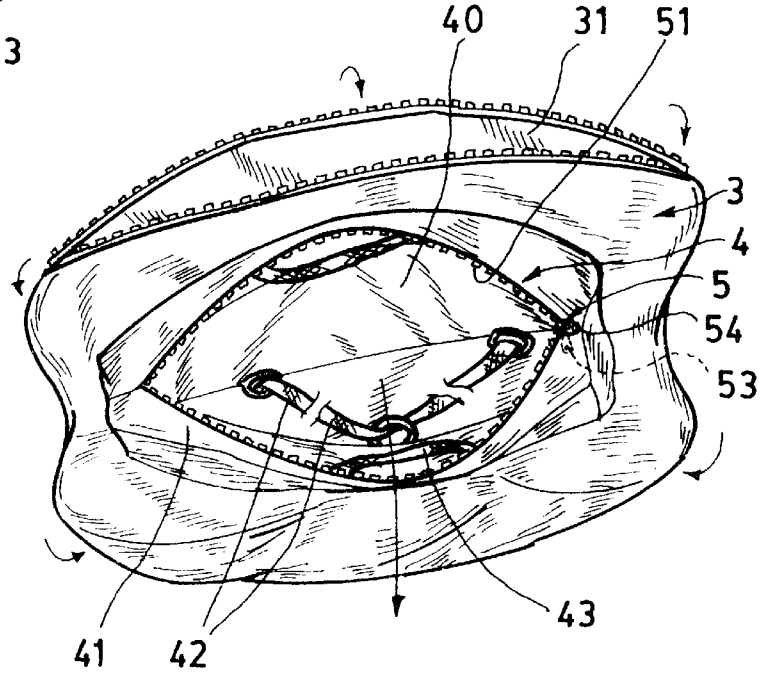
FIG. 7 shows a first step for forming and inverting the built-in carrying bag outwardly for storing the folded leg bag into the carrying bag in accordance with the present invention.
Figure 6:
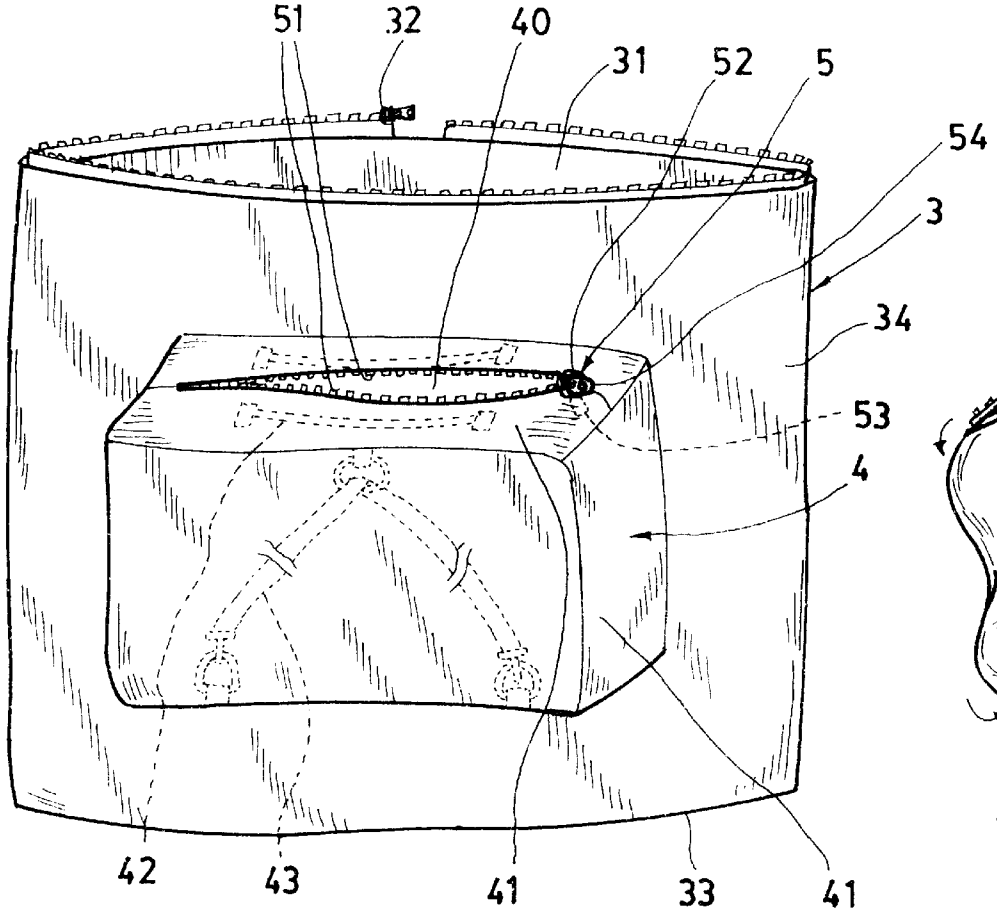
FIG. 6 shows the leg bag and the built-in carrying bag of the present invention.

The hood 2 includes: a row of hood-side zipper teeth 21 formed on a bottom edge of the hood 2 to be engaged with the collar-side zipper teeth 14 of the hood zipper Z1 formed on the torso bag for fastening the hood 2 to the torso bag 1, a hood portion 22 generally formed as an open bag for shielding the wearer's head, and an inflatable pillow portion 23 attached to the hood portion 22 and inflated for cushioning the wearer's head (FIG. 4).

Figure 3:
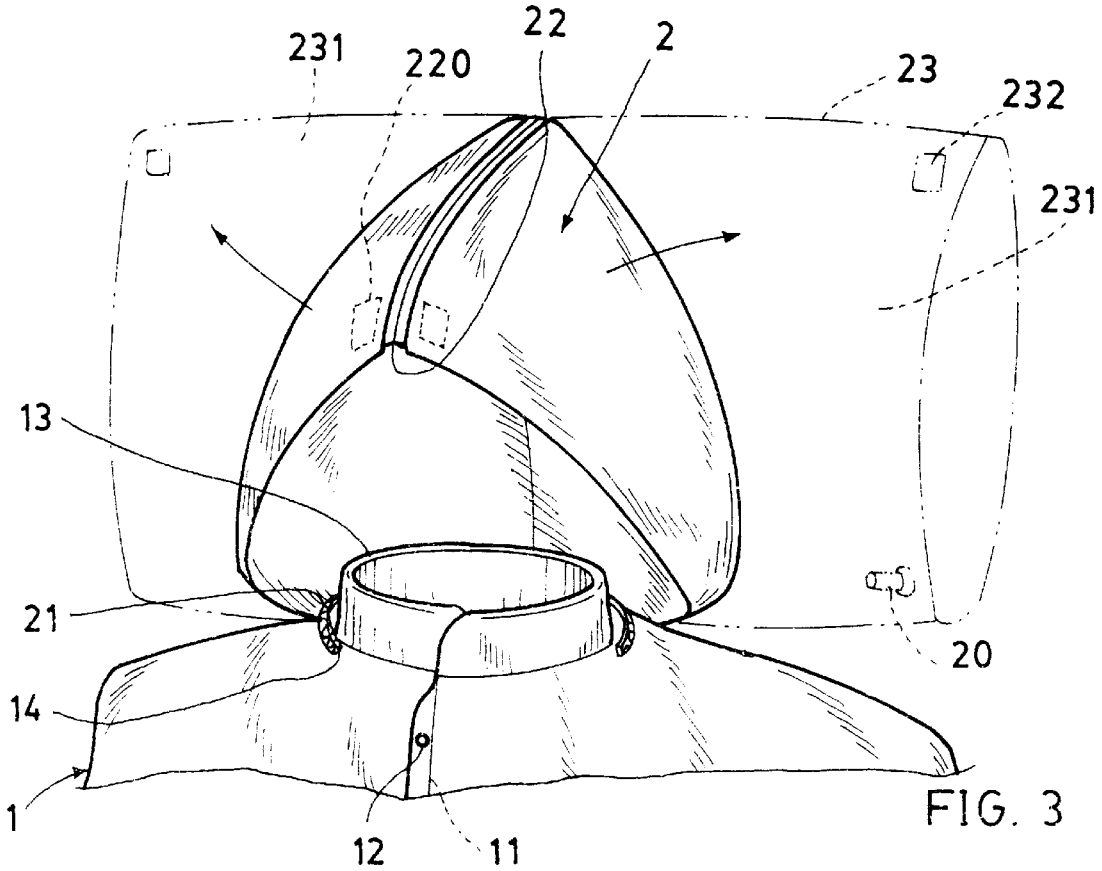
FIG. 3 shows a folded pillow portion secured to the hood of the present invention.

As shown in FIG. 3, the inflatable pillow portion 23 includes two side cells 231 disposed on opposite sides of the hood portion 22 and folded to the hood portion 22 by fasteners 232 which are fixed on the side cells 231 and fastened to the fastener base 220 formed on the hood portion 22, and an inflator 20 for inflating the side cells. The fastener 232 may be selected from a Velcro tape or other fasteners.

Figure 13:
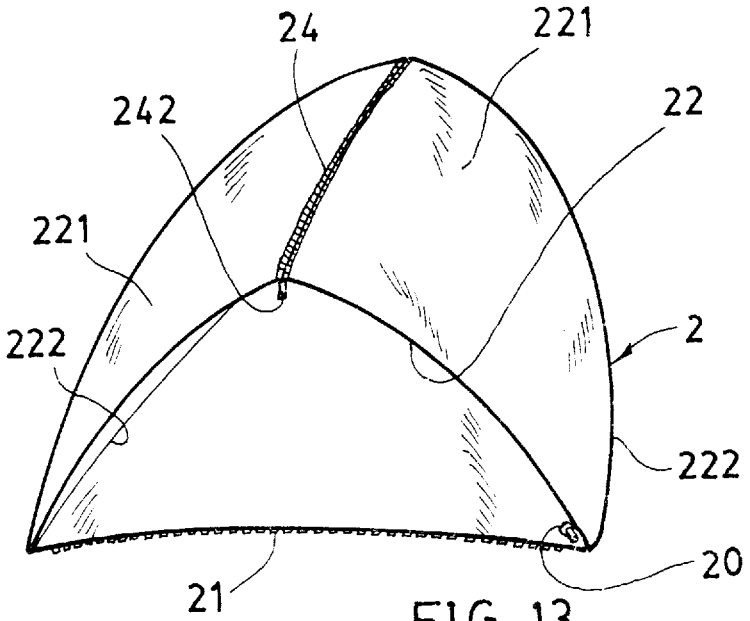
FIG. 13 is a perspective view of another preferred hood of the present invention.
Figure 14:
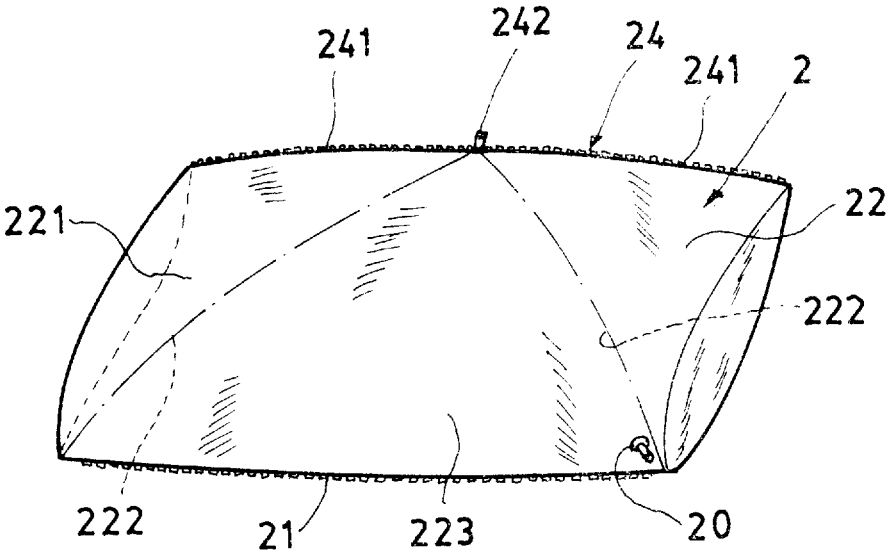
FIG. 14 shows an inflated pillow as derived from the unfolded hood as shown in FIG. 13.

As shown in FIGS. 13, 14, the hood 2 may be modified to include: two side cells 221 disposed on opposite sides of a base cell 223 generally triangular shaped, with the two side cells 221 operatively folded over the base cell 223 along two folding lines 222 aligned with two triangular sides of the base cell 223 to form a tetrahydron-shaped hood by a top zipper 24 consisting of two rows of top zipper teeth 241 linearly formed on a top edge of the two side cells 221 and fastened by pulling a sliding tab 242 of the top zipper 24 (FIG. 13) for engaging the two rows of top zipper teeth 241, and an inflater 20 communicated with the side cells and the base cell and inflated for cushioning the wearer's head.

The leg bag 3 has a bottom closed end 33 opposite to its top opening 31, and a hip (or rear) layer 34 secured with the carrying bag 4 on the hip layer 34.

Figure 9:
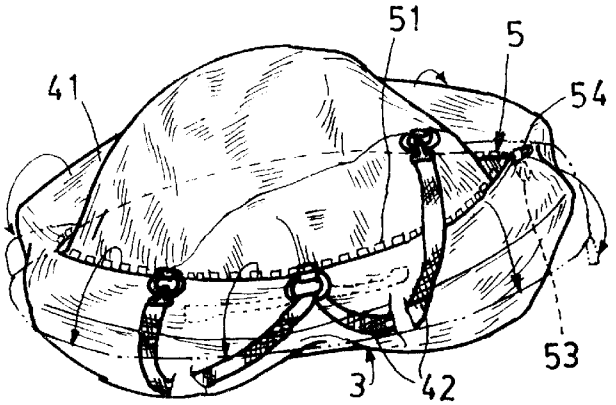
FIG. 9 shows a third step for forming the carrying bag.
Figure 10:
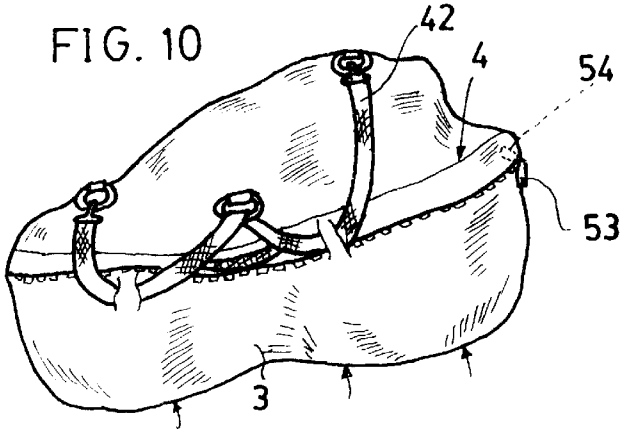
FIG. 10 shows a fourth step for forming the carrying bag.
Figure 8:
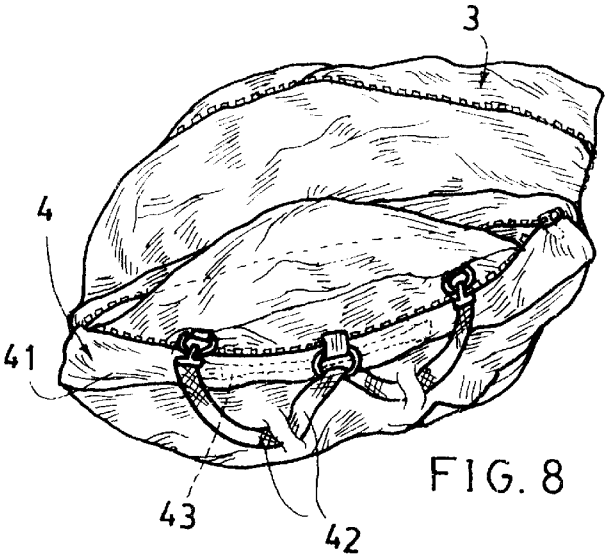
FIG. 8 shows a second step for forming the carrying bag of the present invention following FIG. 7.
Figure 9A:
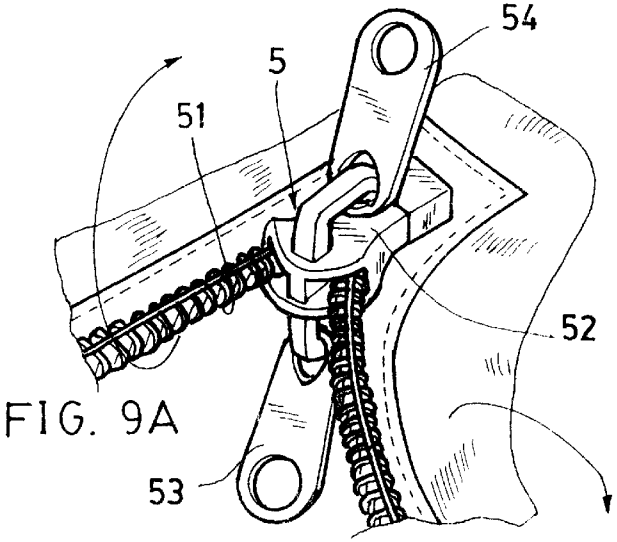
FIG. 9A shows a double-side zipper of the carrying bag of the present invention.
Figure 12:
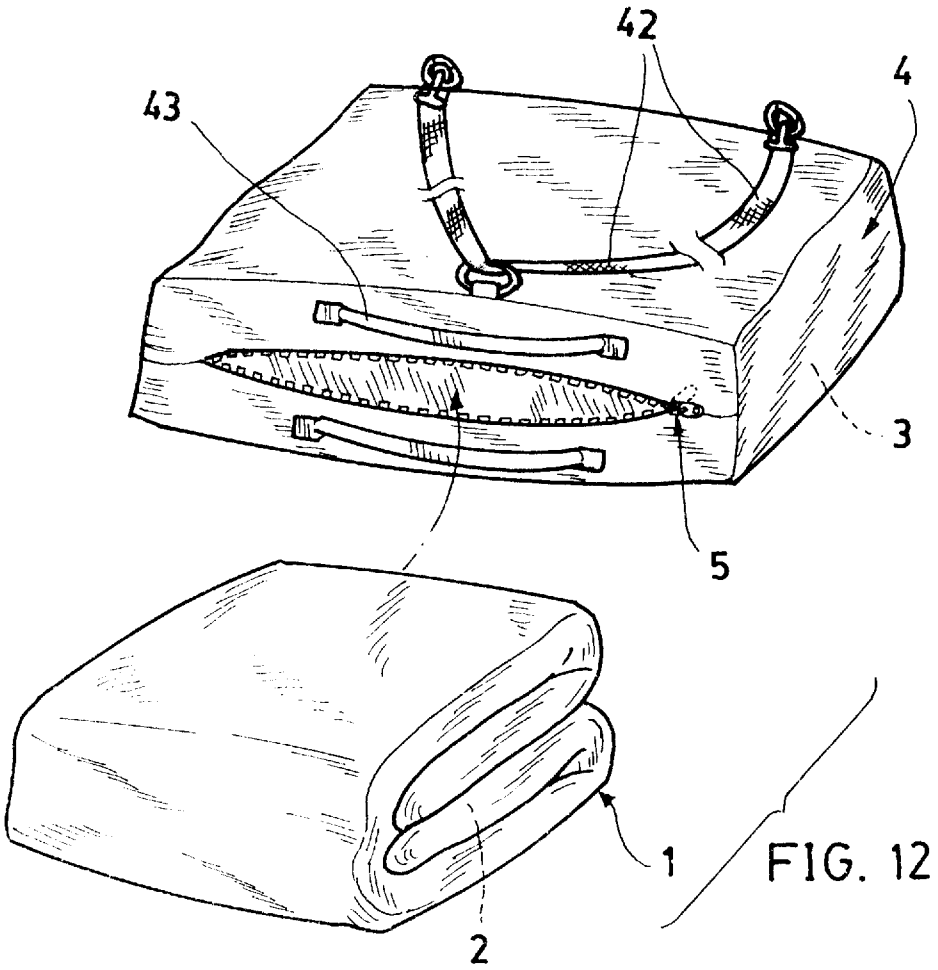
FIG. 12 is an illustration showing that the torso bag and the hood may be stored into the carrying bag.
Figure 11:
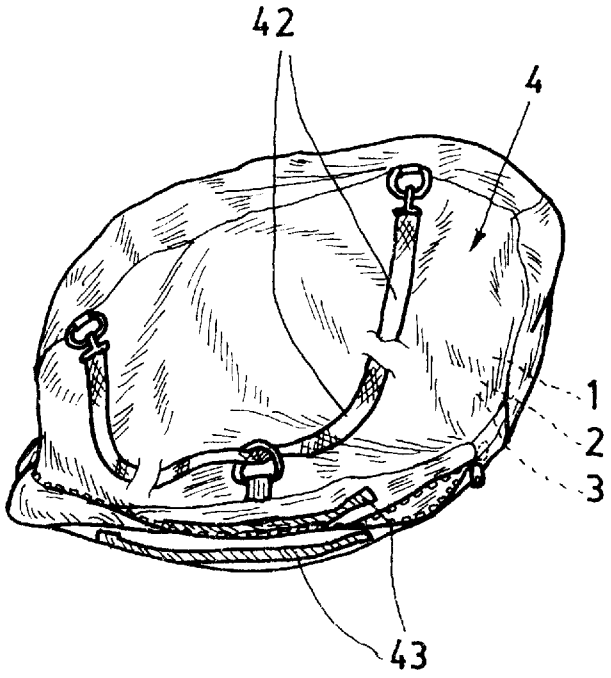
FIG. 11 shows the carrying bag as inverted from the leg bag which is now stored within the carrying bag.

The built-in carrying bag 4 as inherently formed in the leg bag 3, after being separated from the torso bag 1 by unzipping the lower zipper Z3, can be inverted and formed as an "independent" carrying bag for carrying purpose as shown in FIGS. 11, 12 by the unfolding steps as shown in FIGS. 6–11 as hereinafter described.

The built-in carrying bag 4 includes: a bag cover 41 attached to a hip (or rear) layer 34 of the leg bag 3, at least a back strap or shoulder strap 42 and a pair of hand straps 43 respectively secured to the carrying bag 4, and a double-side zipper 5 having two rows of zipper teeth 51 circumferentially formed on a rim of a bag opening 40 formed on a top of the built-in carrying bag 4 and having a first and a second pull handles 53, 54 pivotally connected to an inner and an outer side of a sliding tab 52 operatively engaging the two rows of zipper teeth 51, whereby upon inversion of the built-in carrying bag 4 from the leg bag 3 and also inversion of the double-side zipper 5, an independent carrying bag is formed for carrying purpose.

An shown in FIGS. 6–11, the back strap or shoulder strap 42 of the carrying bag 4 is pulled outwardly and the double-side zipper 5 is inverted outwardly; the remaining portion of the leg bag 3 being folded and inserted in the carrying bag 4 after being inverted (FIG. 10). The first pull handle 53 as originally held within the bag cover 41 as shown in FIG. 9 is then inverted outwardly to be an "outer" pull handle; while the second pull handle 54 as originally exposed outwardly will then be alternatively inverted inwardly as shown in FIG. 10. Therefore, the built-in carrying bag 4 will be inverted, unfolded and formed as an "independent" carrying (hand) bag, travelling bag, or a satchel for storing the torso bag 1, the hood 2, and other items into the bag 1 for convenient handling or storage uses.

The present invention is superior to the prior art with the following advantages:

1. A carrying bag 4 is inherently built in the leg bag 3 for forming in situ a traveling bag (or hand bag or satchel) on the article of the present invention for an instant and direct carrying use.
2. The inflatable pillow portion or inflatable hood can be conveniently served as a pillow for cushioning the wearer's head when the article is converted to be a sleeping bag.
3. The article can be converted to be a sleeping bag, a jacket, a vest and a carrying bag for multiple uses.

The present invention may be modified without departing from the spirit and scope as claimed in this invention.

I claim:

1. A convertible article comprising: a torso bag (1) having a hood (2) detachably securable with the torso bag (1) and operatively inflated for cushioning a wearer's head; a leg bag (3) detachably securable with the torso bag (1) for forming a sleeping bag to be worn by the wearer for sleeping; and a built-in carrying bag (4) formed in the leg bag (3), whereby upon inversion of the built-in carrying bag (4) outwardly from the leg bag (3) and insertion of the leg bag (3) into the carrying bag (4), the carrying bag (4) is stored with the torso bag (1), the hood (2) and the leg bag (3) into the carrying bag for carrying use.

2. A convertible article according to claim 1, wherein said torso bag (1) is generally cylindrical shaped and includes: a longitudinal zipper (11) formed in a front portion of the torso bag (1) for opening or closing the torso bag (1), a collar (13) formed on an upper portion of the torso bag (1) corresponding to a wearer's neck portion, a row of collar-side zipper teeth (14) of a hood zipper (Z1) partially disposed around the collar (13) and engageable with a row of hood-side zipper teeth (21) of the hood zipper (Z1) formed on the hood (2) for fastening the hood (2) on the torso bag (1) adjacent to the collar (13), a pair of shoulder openings (15) formed in opposite sides of a shoulder portion of the torso bag (1) each said shoulder opening (15) having a row of shoulder-side zipper teeth (151) of a sleeve zipper (Z2) circumferentially formed on a rim of the shoulder opening (15) for engaging a row of sleeve-side zipper teeth (161) circumferentially formed on a rim of a sleeve (16) connectable to the shoulder portion of the torso bag (1), and a torso bottom opening (18) formed at a bottom of the torso bag (1) having a row of torso-bottom zipper teeth (181) circumferentially formed on a rim of the torso bottom opening (18) for engaging a row of leg-side zipper teeth (32) of a lower zipper (Z3) circumferentially formed on a rim of a top opening (31) of the leg bag (3).

3. A convertible article according to claim 2, wherein said shoulder opening (15) is formed with a closable zipper (152) circumferentially formed on an inner edge of the rim of the shoulder opening (15) and is closed for forming a sleeping bag of the torso bag (1).

4. A convertible article according to claim 2, wherein said hood (2) includes: a row of hood-side zipper teeth (21) formed on a bottom edge of the hood (2) to be engaged with the collar-side zipper teeth (14) of the hood zipper (Z1) for fastening the hood (2) to the torso bag (1), a hood portion (22) generally formed as an open bag for shielding the wearer's head, and an inflatable pillow portion (23) attached to the hood portion (22) and operatively inflated for cushioning the wearer's head.

5. A convertible article according to claim 4, wherein said inflatable pillow portion (23) includes two side cells (231) disposed on opposite sides of the hood portion (22) and folded to the hood portion (22), and an inflator (20) communicated with said side cells (231) for inflating the side cells.

6. A convertible article according to claim 1, wherein the hood (2) includes: two side cells (221) disposed on opposite sides of a base cell (223) generally triangular shaped, with the two side cells (221) operatively folded over the base cell (223) along two folding lines (222) aligned with two triangular sides of the base cell (223) to form a tetrahydron-shaped hood by a top zipper (24) consisting of two rows of top zipper teeth (241) linearly formed on a top edge of the two side cells (221) and operatively fastened by pulling a sliding tab (242) of the top zipper (24) by engaging the two rows of top zipper teeth (241), and an inflater (20) communicated with the side cells (221) and the base cell (223) and operatively inflated for cushioning the wearer's head.

7. A convertible article according to claim 1, wherein said built-in carrying bag (4) includes: a bag cover (41) attached to a layer of the leg bag (3), at least a back strap (42) and a pair of hand straps (43) respectively secured to the carrying bag (4), and a double-side zipper (5) having two rows of zipper teeth (51) circumferentially formed on a rim of a bag opening (40) formed on a top of the built-in carrying bag (4) and having a first and a second pull handle (53,54) pivotally connected to an inner side and an outer side of a sliding tab (52) operatively engaging the two rows of zipper teeth (51), whereby upon inversion of the built-in carrying bag (4) from the leg bag (3) and inversion of the double-side zipper (5) for alternating an inner pull handle outwardly to be an outer pull handle of the double-side zipper (5), a carrying bag is independently formed for carrying purpose.

* * * * *